United States Patent [19]

Portscheller

[11] 4,369,419

[45] Jan. 18, 1983

[54] SOLENOID HAVING SPRING BIASED LOST MOTION LINK

[75] Inventor: James I. Portscheller, Sparland, Ill.

[73] Assignee: Caterpillar Tractor Co., Peoria, Ill.

[21] Appl. No.: 298,834

[22] PCT Filed: Aug. 21, 1981

[86] PCT No.: PCT/US81/01129

§ 371 Date: Aug. 21, 1981

§ 102(e) Date: Aug. 21, 1981

[51] Int. Cl.[3] ..... H01F 7/08

[52] U.S. Cl. ..... 335/255; 335/259; 335/265

[58] Field of Search ..... 335/255, 257, 258, 259, 335/265, 267, 239, 251

[56] References Cited

U.S. PATENT DOCUMENTS

| | | | |
|---|---|---|---|
| 2,318,191 | 5/1943 | Bloomfield | 76/46 |
| 2,415,739 | 2/1947 | Fuchs | 175/341 |
| 2,808,281 | 10/1957 | Poe | 292/251.5 |
| 2,915,681 | 12/1959 | Troy | 317/123 |
| 2,931,233 | 4/1960 | Griswold | 74/104 |
| 3,301,141 | 1/1967 | Griffing | 92/143 |
| 3,473,780 | 10/1969 | Harms | 335/259 |
| 3,665,353 | 5/1972 | Campbell | 335/258 |
| 3,961,298 | 6/1976 | Jaffe et al. | 335/265 |
| 3,988,706 | 10/1976 | Springer | 335/264 |
| 4,056,799 | 11/1977 | Bauer | 335/277 |

*Primary Examiner*—Harold Broome
*Attorney, Agent, or Firm*—Krass & Young

[57] ABSTRACT

A solenoid having a linear pull stroke includes a coil operated plunger (16) having a lost motion coupling (20,28,32,38,40) adapted to be connected with a load in order to allow the plunger (16) to retract a predefined distance during the initial part of the stroke thereby to develop a higher level of pulling force before substantial force is actually imparted to the load. The plunger (16) comprises an elongate body (18) having a piston-like link (28) slidably mounted in a cavity (20) at one end of the body (18) and adapted to be coupled with the load. A spring (36) trapped between the link (28) and the body (18) resets the link (28) relative to the body (18) before the pull stroke is completed.

12 Claims, 5 Drawing Figures

SOLENOID HAVING SPRING BIASED LOST MOTION LINK

DESCRIPTION

1. Technical Field

This invention relates to electrically operated solenoids, and more particularly to a solenoid having a plunger which includes a spring biased lost motion link adapted to be connected to a load.

2. Background Art

Various types of electromagnetically operated solenoids are well known in the art. Many of such solenoids are of the type having a linearly shiftable plunger member disposed within an electrically energizable coil. The plunger is coupled with a load which is normally operated by a mechanical connection that causes the plunger to shift away from the coil. Energization of the coil using a D.C. electrical source creates a magnetic field around the plunger which urges the plunger to shift linearly back toward the coil, thereby displacing the load.

Some types of prior art solenoids employ dual coils; one coil is of a low resistance type and is particularly designed to produce magnetic fields which develop a high initial pulling force on the plunger. The other coil is of a high resistance type which generates a relatively low level of pulling force and merely functions to hold the plunger in its actuated position after the plunger has displaced the load.

Solenoids of the type described above are typically employed for operating engine throttles, chokes, valves, clutches and any other device requiring a linear stroke. Some of these applications involve loads which present a relatively high initial resistance to the solenoid, due to starting friction and the like. Due to their inherent design, these solenoids develop a minimum level of pulling force when the plunger is fully extended, since in the fully extended position, the magnetic field produced by the coil exerts the least amount of influence on the magnetically attracted plunger.

As a consequence of the above, it has been necessary in the past to resort to dual coil type or oversized solenoids in order to develop sufficient pulling force on the initial part of the retraction stroke thereby to "break loose" the load. Obviously, dual coil and oversized single coil solenoids are more costly to manufacture due to their complexity and size compared to a simple, single coil solenoid which is matched to meet the minimum pull force requirement for a particular application.

DISCLOSURE OF THE INVENTION

The present invention overcomes the disadvantages of prior art solenoids through the provision of a plunger having a spring biased, lost motion link connection to the load which has the net effect of increasing the initial pulling force imparted to the load, thereby allowing a coil of minimum capacity to be employed in a given application.

More specifically, the solenoid comprises a casing, a single electrically energizable coil within the casing, and an elongate plunger assembly slidably mounted in an opening in the coil. The plunger assembly includes an elongate body and a lost motion link adapted to be coupled with the load and mounted on one end of the body for sliding movement relative to the body. A spring trapped between the link and the plunger body normally biases the body in a direction toward the link thereby to normally maintain the link and the plunger body in retracted operating relationship relative to each other. In the absence of abnormally high starting resistance presented by the load, the plunger body and link remain in retracted relationship relative to each other throughout the entire pulling and return strokes of the plunger assembly, i.e., the plunger body does not shift relative to the link or the load. The link is defined by a piston-like member slidably confined in a cavity within one end of the plunger body. In the event that the load presents an abnormally high level of starting resistance to the solenoid, the link allows the plunger body to shift away from the link (and therefore from the load) a predefined distance into the coil without displacing the load. This partial displacement of the plunger body into the coil increases the magnetic influence imparted thereto by the coil, consequently, the magnitude of pulling force developed by the plunger is substantially increased before the solenoid exerts substantial pulling force on the load. When the plunger body is fully extended relative to the link, the link bottoms out and maximum pulling force is imparted by the solenoid to the load thereby overcoming the starting resistance of the load. The impact imparted by the momentum of the plunger to the load also assists in breaking away loads which are slightly stuck. As the plunger continues its pulling stroke, the spring returns the link and the plunger body to their normal retracted relationship relative to each other, thereby resetting the plunger assembly for the next pulling stroke.

BEST MODE FOR CARRYING OUT THE INVENTION

Figure 1:
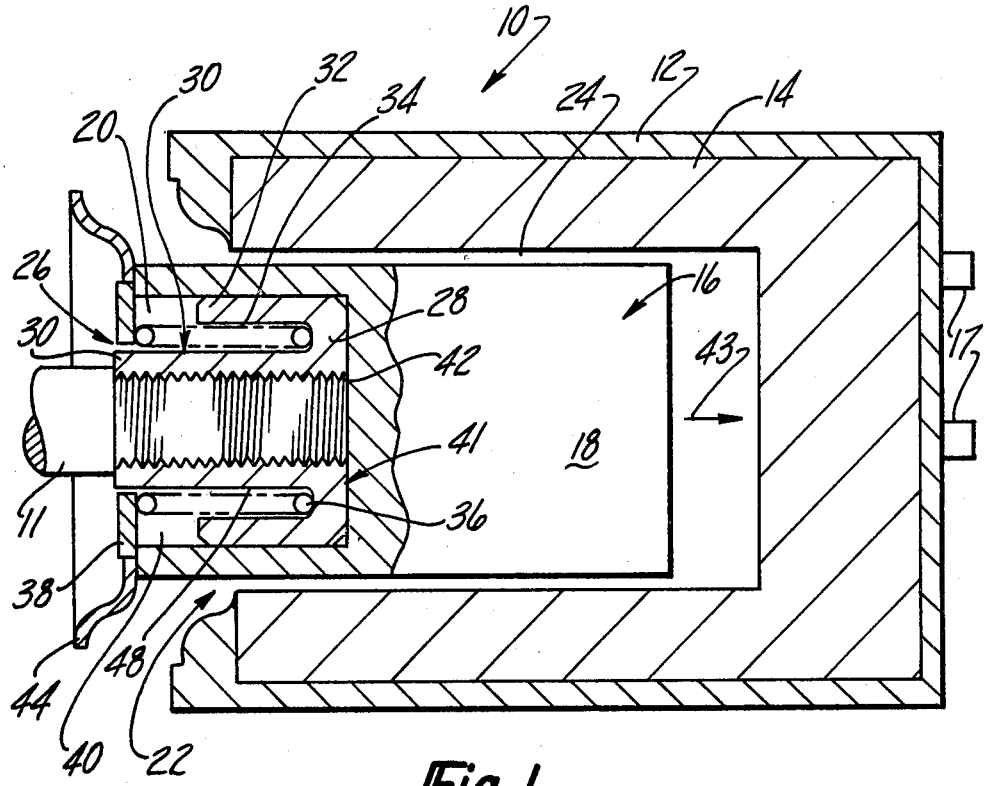
FIG. 1 is a side elevational view of the solenoid forming the preferred embodiment of the present invention, parts being broken away in section to reveal the plunger assembly in the fully extended starting position thereof, with the link and the plunger body in normal retracted relationship relative to each other.

Referring now to the drawings, a solenoid generally indicated by the numeral 10 is particularly adapted to provide a pulling stroke for operating various types of loads (not shown) connected to the solenoid 10 by a connecting rod 11. Solenoid 10 is of the D.C. type and has a pair of terminals 17 suitable for connection to a source of direct current electrical power.

Solenoid 10 comprises an outer, cylindrically-shaped housing 12 having an opening 22 in one end thereof. A single coil 14 of the conventional type is mounted within the casing 12 and is provided with a cylindrically-shaped opening 24 therein. A plunger assembly 16 is slidably confined within the opening 24 and extends through opening 22 into the casing 12. Plunger assembly 16 comprises a cylindrically-shaped body 18 of magnetizable material which is provided with a cylindrically-shaped cavity 20 in the outer end thereof. An annularly-shaped, concave rim 44 is secured to the periphery of the body 18 adjacent the cavity 20. A ring-shaped, radially extending retainer 38 is secured to the rim 44 as by welding and defines a substantially circular-shaped opening 26 in the end of body 18. A link member 28 is slidably confined within cavity 20 for sliding movement in a direction coaxial with the longitudinal axis of both the body 18 and solenoid 10. Link member 28 and retainer 38 form a lost motion link which allows relative axial movement between rod 11 and plunger body 18.

Link member 28 comprises a barrel-shaped portion 30, and a ring-shaped seat portion 32 circumscribing the barrel portion 30 and radially spaced therefrom to define an annularly-shaped depression or passageway 34 in the link member 28. Barrel portion 30 extends outwardly through the opening 26 in the body 18, while the outer extremities of the seat portion 32 are normally spaced from the retainer 38 (in the absence of abnormally high starting resistance presented by the load) to define a lost motion clearance space 40. Clearance space 40 defines the extent of lost motion or potential axial displacement of the link member 28 relative to the plunger body 18. Biasing means in the nature of a helically-shaped compression spring 36 is sleeved over the barrel portion 30 and is received within the annular depression 34 so as to be trapped between the link member 28 and retainer 38. Barrel portion 30 is provided with a longitudinally extending threaded bore 42 located centrally therein for threadably coupling with connecting rod 11. An anti-rotational guide defined by a flat 46 is provided along an edge of the retainer 38. The barrel portion 30 includes a longitudinally extending beveled section 48 which clears the flat 46 upon extension of the plunger assembly 16 from the coil 14.

INDUSTRIAL APPLICABILITY

As previously indicated, the solenoid 10 is suitable for use in operating various kinds of mechanical devices wherein a linear pulling stroke is required to shift a load. A suitable source of D.C. electrical power is connected to the terminals 17, and the solenoid 10 is mounted by any appropriate means at a location adjacent the load. The connecting rod 11 is threaded into the bore 42 of the link 28, thereby connecting the plunger assembly 16 with the load. Prior to energization of the solenoid 10, the plunger assembly 16 is disposed in a fully extended position as shown in FIG. 1; in this position, the spring 36 biases the plunger body 18 toward link member 28 which engages endwall 41, thereby creating the clearance space 40.

The load will typically include a mechanical or hydraulic linkage coupled with the connecting rod 11 which initially shifts the plunger assembly 16 to its fully extended position depicted in FIG. 1. Upon initial energization of the solenoid 10, a magnetic field produced by the coil 14 imparts an attractive pulling force on the plunger body 18 which causes the latter to retract in the direction indicated by arrow 43. However, since the plunger assembly 16 is fully extended, a substantial portion of the body 18 is beyond the immediate influence of the magnetic field created by the coil 14. Consequently, only a minimal level of pulling force may be imparted by the solenoid 10 to the load as the plunger assembly 16 initiates the retraction stroke.

The spring 36 will be selected such that the spring preload force thereof is slightly greater than the magnitude of force required to pull the load under normal conditions when the load does not present an abnormally high resistance due to starting friction or the like, but is less than the minimum level of pulling force developed by the solenoid 10.

Assuming for the moment that the load does not present an abnormally high level of resistance to the solenoid 10, upon energization of the coil 14 plunger body 18 will begin retracting into the coil 14. Since the force exerted by spring 36 urging the link member 28 toward endwall 41 exceeds the force required to pull the load, the link member 28 remains in contact with endwall 41 and the pulling force developed by the coil 14 is immediately transmitted by the lost motion link to the rod 11. Link member 28 and plunger body 18 remain in a retracted relationship relative to each other throughout the entire pulling and return strokes under this ideal load condition.

Figure 2:
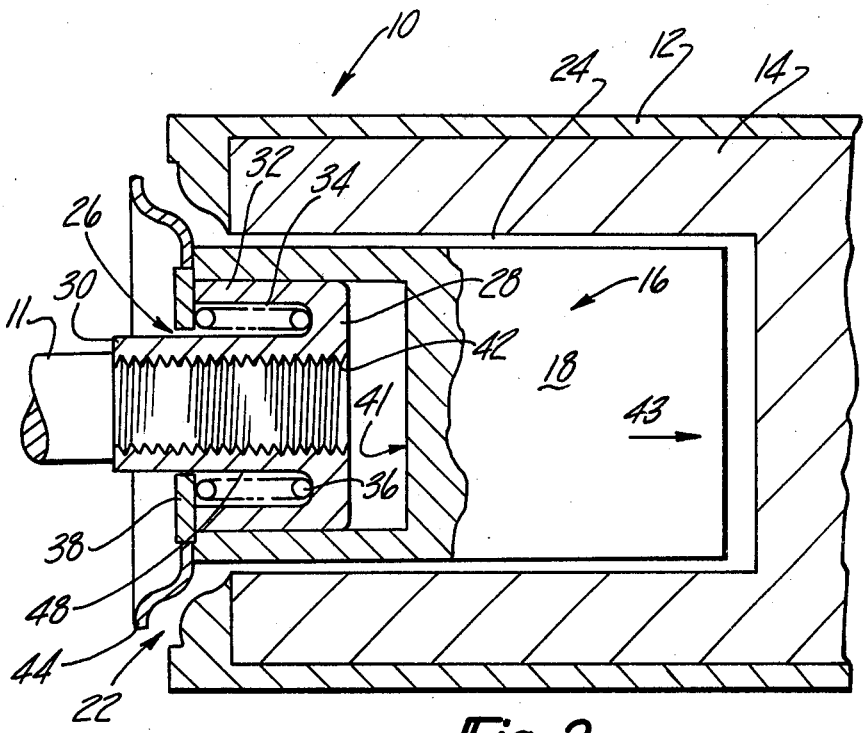
FIG. 2 is a view similar to FIG. 1, but showing the plunger assembly partially retracted during a pulling stroke, with the link having bottomed out.

If, however, the load initially drags or sticks due to starting friction or the like, the solenoid 10 operates in the following manner. As coil 14 is energized, the plunger body 18 begins retracting; the force imposed on the plunger body 18 by the coil at this point will be less than that required to "break loose" the load. The plunger body 18 is nevertheless allowed to retract under the influence of the coil 14 because the pulling force imposed on the plunger body 18 overcomes the compressive force developed by the spring 36; consequently, the spring 36 compresses, thereby allowing the plunger body 18 to retract toward the coil 14 while the link member 28 and rod 11 remain stationary. The plunger body 18 continues to retract relative to the stationary link member 28 through a distance corresponding to the clearance space 40 until the outer extremity of the seat portion 32 engages and bottoms out on the retainer 38 as shown in FIG. 2. At this point, a substantial pulling force imparted to the plunger body 18 by coil 14 is transmitted through link member 28 to the load via rod 11; it may be appreciated that the magnitude of pulling force thus developed at the point in the pulling stroke when the link member 28 engages the retainer 38 is considerably greater than that developed when the plunger body initially commences retracting because a greater volume of the plunger body 18 is within the immediate magnetic influence of the coil 14 when the plunger body 18 has partially retracted. This increased level of pulling force transmitted to the load is more than sufficient to overcome the abnormally high resistance presented by the load, consequently the load "breaks loose" and is displaced along with continued travel of plunger body 18. Additionally, the impact delivered to to the load as a result of the plunger body's momentum further aids in breaking the load loose.

Figure 3:
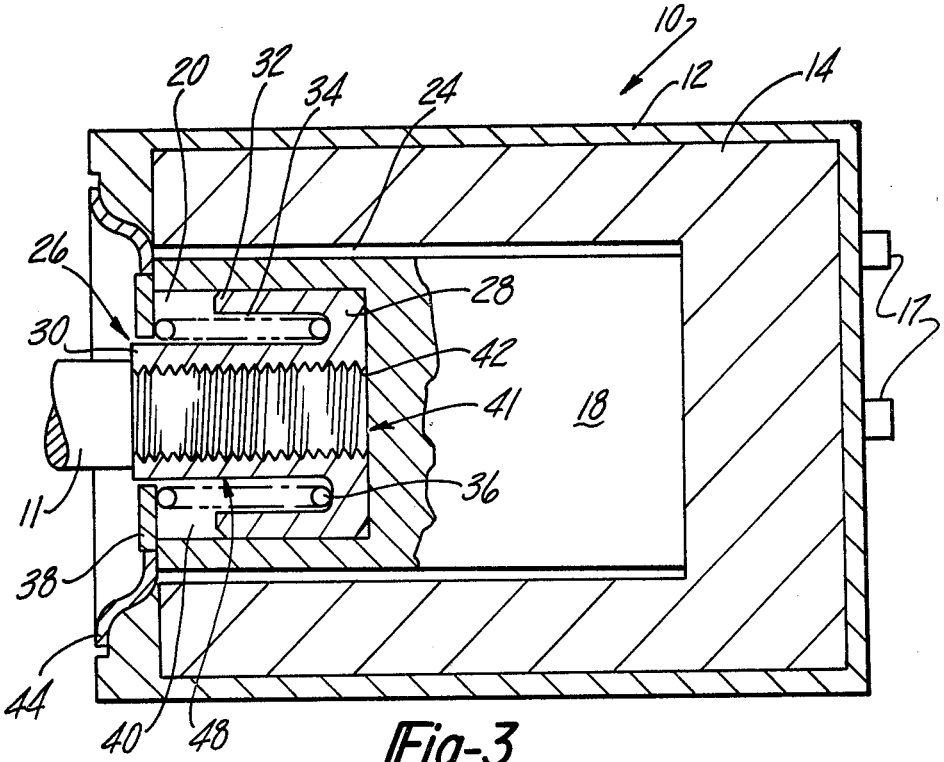
FIG. 3 is a view similar to FIGS. 1 and 2, but showing the plunger assembly at the end of its pulling stroke in a fully retracted position, the link and plunger body having returned to their retracted relationship relative to each other.
Figure 4:
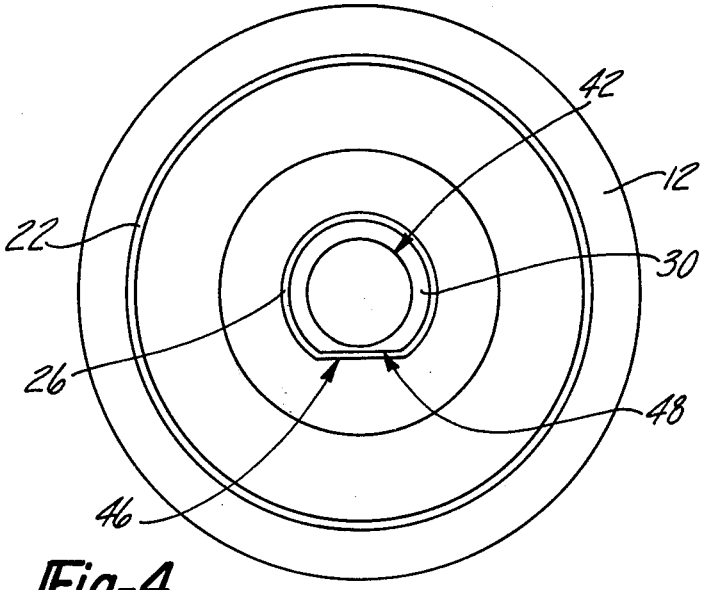
FIG. 4 is an elevational view of one end of the solenoid shown in FIGS. 1–3 depicting a portion of the plunger assembly.

Immediately upon overcoming the abnormally high resistance presented by the load, the spring 36 causes the link member 28 to return to its normal retracted position engaging endwall 41 since, as previously mentioned, the compressive force developed by spring 36 exceeds that required to pull the load under normal conditions. The link member 28 returns to its normal position engaging endwall 41 before plunger body completes its pulling stroke as shown in FIG. 3. The link member 28 and plunger body 18 remain in this retracted relationship relative to each other during the return stroke of plunger assembly 16 to its fully extended position shown in FIG. 1, and remain in such relationship until acted upon during a subsequent pulling stroke by abnormally high load resistance.

Figure 5:
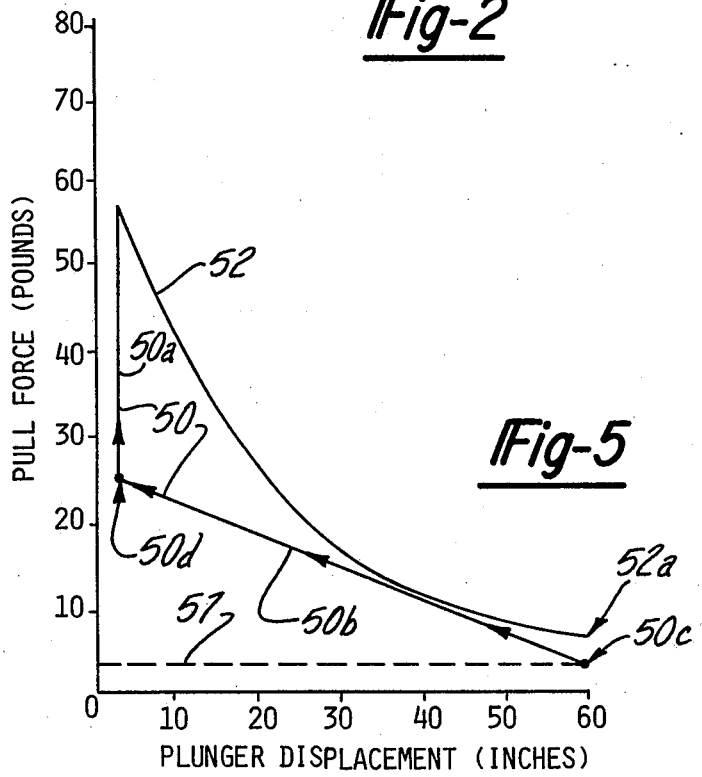
FIG. 5 is a graph depicting the magnitude of pulling force imparted by the solenoid of the present invention in comparison to a comparable prior art, oversized single coil type solenoid, as a function of the extension of the plunger assembly from the coil.

The improved performance characteristics afforded by the solenoid 10 are graphically depicted in FIG. 5 along with those of a typical oversized prior art solenoid employed for the same load application. In FIG. 5, ascending values on the ordinate represent increased pulling power imparted to the load while decreasing values on the abscissa designate the magnitude of displacement of plunger body 18 from its fully extended starting position to its retracted position during a pulling stroke. The curve designated by the numeral 50 indicates the performance of the solenoid 10 of the present invention while curve 52 charts the performance of the prior art solenoid. The dotted line 57 indicates the minimum level of force required to pull the load under normal conditions, where the load presents a minimum amount of resistance to displacement thereof as occurs after starting friction is overcome.

Curve portion **50*b* represents the force produced by the spring 36 (i.e., spring load) while curve portion 50*a* designates the force applied to the load by the coil 14 after the link member 28 bottoms out. Since the spring 36 must develop a force sufficient to pull the load under normal resistance conditions, the lowest point 50*c* of curve portion 50*b* must intersect or be marginally above the line 57. Curve portion 50*b* corresponds to that part of the pulling stroke in which plunger body 18 is retracted while link member 28 remains stationary thereby loading the spring 36. In other words, the displacement of the plunger body 18 under curve portion 50*b* is equivalent to the clearance space 40**.

When link member 28 bottoms out on the retainer 38 at point **50*d*, the force being developed by the coil 14 is transferred to the load. At point 50*d* it can be seen that the level of force imparted through the plunger assembly 16 to the load is more than ten times the minimum level required to pull the load under normal resistance conditions; this substantial level of force is more than adequate to overcome virtually any abnormally high level of starting resistance presented by the load. The magnitude of the force multiple mentioned above will depend to some extent on the physical characteristics of the spring 36 which is selected and the distance over which such spring 36** is compressed during the plunger operation.

In contrast, the minimum level of force developed by the prior art solenoid at point **52*a* (when the plunger thereof is fully extended) defines the maximum level of force which is available to overcome starting resistance presented by the load and is only approximately twice the minimum force required to pull the load under normal load resistance conditions. Thus, it may be readily appreciated that the solenoid 10** of the present invention applies more than five times the amount of force to the load in order to overcome starting resistance compared to the prior art solenoid.

One typical application of the solenoid 10 of the present invention involves the operation of a butterfly-type valve (not shown) in which a valve plate carried by a rotatable shaft is spring biased toward a closed position. The solenoid of the present invention is provided with a rod member which is adapted to interfit with an extension on the rotatable valve shaft so as to normally prevent closing of the valve. Actuation of the solenoid moves the rod into clearing relationship to the shaft extension, thereby allowing the spring loaded valve to close. In the application of the solenoid described above, the solenoid retaining rod frictionally engages the shaft extension, so that it becomes necessary to initially apply a relatively large pulling force on the rod so as to overcome starting friction. This increased level of initial pulling force is provided by the solenoid of the present invention as previously discussed.

Other aspects, objects and advantages of this invention can be obtained from a study of the drawings, the disclosure and the appended claims.

I claim:

1. In a solenoid having an electrically energizable coil (14) and a magnetically attractive plunger (18) adapted to be coupled with a load (11), said plunger (18) being movable in response to activation of said coil (14) between a plunger first position, with which there is an associated load first position, and a plunger second position, with which there is an associated load second position, the improvement comprising:

lost motion link means (20,28,32,38,40) for connecting said plunger (18) and said load (11) and freeing said plunger for movement from said plunger first position toward said plunger second position while said load (11) remains stationary, said link means (20,28,32,38,40) including biasing means (36) for biasing said load (11) toward said load second position in response to said plunger (18) being moved from said plunger first position to said plunger second position.

2. A solenoid as set forth in claim 1, wherein said plunger (18) includes an opening (24) in one end thereof and said lost motion link means (20,28,32,38,40) includes a link member (28) slidably disposed within said opening (24) and means (38) for retaining said link member (28) within said opening (24).

3. A solenoid as set forth in claim 2, wherein said biasing means (36) includes a spring (36) captively held within said opening (24) and extending between said link member (28) and said retaining means (38).

4. A solenoid as set forth in claim 3, wherein said opening (24) is cylindrical in shape and said retaining means (38) includes an annularly-shaped element (38) secured to said plunger (18) and having an aperture (26) therein through which said link member (28) extends in said second position of said lost motion link means (20,28,32,38,40).

5. A solenoid as set forth in claim 3, wherein said link member (28) includes:

a barrel portion (30) having said spring (36) sleeved thereover and adapted to be coupled with said load (11); and a seat portion (32) radially spaced from said barrel portion (30) and defining a depression (34) within which said spring (36) is disposed.

6. A solenoid as set forth in claim 5, wherein said plunger (18) and said barrel portion (30) are each cylindrical in shape and said barrel portion includes a threaded bore (42).

7. A solenoid as set forth in claim 2, wherein at least a portion (32) of said link member (28) is spaced from said retaining means (38) and defines a clearance space (40).

8. A solenoid as set forth in claim 1, wherein said biasing means (36) includes a spring (36) having a spring rate sufficient in magnitude to pull said load (11) toward said load second position thereof but less in magnitude than the minimum force imposed on said plunger (18) by said coil (14).

9. A solenoid as set forth in claim 2, including means (46,48) for substantially preventing rotational movement of said link member (28) relative to said plunger (18).

10. An improved solenoid of the type having a casing (12), an electrically energizable coil (14) within said casing (12) and provided with an opening (24) therein, and a magnetically attractive plunger (18) adapted to be coupled with a load (11) and shiftable within said casing (12) through said opening (24) upon energization of said coil (14) between an extended position in which said load (11) is disposed in a standby position and a retracted position in which said load (11) is pulled to an operated position, the improvement comprising:

lost motion link means (20,28,32,38,40) coupled between said plunger (18) and said load (11) and shiftable from a first position to a second position upon energization of said coil (14) for allowing said plunger (18) to shift a preselected distance from said extended position thereof toward said retracted position thereof while said load (11) remains in said standby position thereof; and biasing means (36) for selectively shifting said lost motion link means (20,28,32,38,40) from said second position thereof to said first position thereof.

11. A solenoid as set forth in claim 10, wherein said plunger (18) includes an opening (24) in one end thereof and said lost motion link means (20, 28,32,38,40) includes a link member (28) slidably disposed within said opening (24) and means (38) for retaining said link member (28) within said opening (24).

12. A solenoid as set forth in claim 11, wherein said opening (24) is partially defined by an endwall (41) in said plunger (18) against which said link member (28) may seat in response to said link means (20,28,32,38,40) being shifted to said first position thereof.

* * * * *

Disclaimer and Dedication 4,369,419.—*James I. Portscheller*, Sparland, Ill. SOLENOID HAVING SPRING BLASED LOST MOTION LINK. Patent dated Jan. 18, 1983. Disclaimer and Dedication filed Sept. 11, 1989, by the assignee, Caterpillar Inc.

Hereby disclaims and dedicates to the Public claims 1-12 of said patent.

[*Official Gazette November 21, 1989* ]